US012259203B2

(12) United States Patent
Kunsky

(10) Patent No.: US 12,259,203 B2
(45) **Date of Patent: *Mar. 25, 2025**

(54) BAFFLE FOR SHOTGUN SUPPRESSOR

(71) Applicant: Jacob Kunsky, Bruneau, ID (US)

(72) Inventor: Jacob Kunsky, Bruneau, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/374,489

(22) Filed: Sep. 28, 2023

(65) Prior Publication Data

US 2024/0255248 A1 Aug. 1, 2024

Related U.S. Application Data

(63) Continuation of application No. 18/103,003, filed on Jan. 30, 2023, now Pat. No. 11,774,205.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/34; F41A 21/36; F41A 21/40; F41A 21/42
See application file for complete search history.

(56) References Cited

U.S. PATENT DOCUMENTS 5,679,916 A 10/1997 Weichert
6,374,718 B1 * 4/2002 Rescigno ..... F41A 21/30 89/14.4
8,100,224 B1 1/2012 Olson
9,163,892 B1 * 10/2015 Buboltz ..... F41A 21/28
10,119,779 B1 11/2018 Miele et al.
10,502,512 B1 * 12/2019 Beaudry ..... F41A 21/28
2012/0272818 A1 11/2012 Dueck et al.
2017/0160035 A1 6/2017 Piemme et al.
2017/0299313 A1 10/2017 Adamson, Jr.
2017/0321984 A1 11/2017 Palu et al.
2018/0313624 A1 11/2018 Smith
2018/0340749 A1 11/2018 Palu et al.
2019/0339036 A1 11/2019 Edminster et al.
2019/0353447 A1 * 11/2019 Palenik, II ..... F41A 21/36
2020/0141679 A1 5/2020 Garst et al.
2020/0224989 A1 * 7/2020 Bundy ..... F41A 21/325
(Continued)

OTHER PUBLICATIONS

United States Patent and Trademark Office; Office Action issued in U.S. Appl. No. 18/103,003; Apr. 11, 2023.

*Primary Examiner* — Joshua E Freeman
(74) *Attorney, Agent, or Firm* — Parsons Behle & Latimer

(57) ABSTRACT

A suppressor for suppressing the discharge of a shotgun. The suppressor includes a base having a first end, a second end, and a first passageway through the base from the first end to the second end. The suppressor includes an end cap having a second passageway with a bell-shaped protrusion along the second passageway. The suppressor includes at least one baffle positioned between the base and the end cap. The baffle includes a lower portion having a first end, a second end, and a first flow path through an interior of the lower portion. The baffle includes an upper portion having an interior, an exterior, and a second flow path through the interior of the upper portion. The upper portion of the baffle includes a first end, a middle section, and a second end. The second end of the upper portion of the baffle may be bell-shaped.

20 Claims, 11 Drawing Sheets

(56) References Cited

U.S. PATENT DOCUMENTS

| | | | | |
|---|---|---|---|---|
| 2021/0341246 | A1* | 11/2021 | Kunsky | F41A 21/30 |
| 2021/0381791 | A1 | 12/2021 | Magee | |
| 2021/0396485 | A1 | 12/2021 | Reis-Green et al. | |
| 2022/0397361 | A1 | 12/2022 | DeJessa | |
| 2022/0397362 | A1 | 12/2022 | DeJessa | |
| 2022/0397363 | A1 | 12/2022 | DeJessa | |
| 2023/0003479 | A1 | 1/2023 | Berg | |

* cited by examiner

BAFFLE FOR SHOTGUN SUPPRESSOR

RELATED APPLICATION

The present application is a continuation-in-part patent application of U.S. patent application Ser. No. 18/103,003 entitled BAFFLE FOR SHOTGUN SUPPRESSOR filed on Jan. 30, 2023, which is incorporated herein in its entirety.

FIELD OF THE DISCLOSURE

The examples described herein relate to apparatuses, systems, and methods of a shotgun suppressor, an end cap, and a baffle for a shotgun suppressor.

BACKGROUND

Description of the Related Art

A firearm suppressor is a device mounted or otherwise attached to the muzzle of a firearm and, through selective use of baffles or other gas-redirection apparatus, operates to diminish the report (as measured in decibels) of a firearm following discharge. By reducing the report of a discharging firearm, suppressors reduce or mitigate hearing damage or loss otherwise resulting from repeated exposure to firearm discharges. A suppressor may be attached to a firearm by various mechanisms.

Firearm suppressors are typically designed for firearms that discharge, or fire, bullets such as handguns and rifles. One type of a firearm, a shotgun, does not typically fire a bullet, but typically fires shot (e.g., a plurality of lead, steel, or other metal pellets). One difficulty in designing a suppressor capable to suppress the discharge of a shotgun is that both a wad and shot are discharged. The wad is a component of the shotgun shell that is used to separate the shot from the powder. The wad provides a seal to propel the shot when the powder is discharged rather than having the gas from the discharge blowing through the shot. The wad typically is made of plastic and expands as it is being discharged from the barrel.

As the wad travels along the suppressor, the wad may expand into gaps between the baffles, which is problematic. The expansion of the wad between baffles may cause the wad to strike the baffles potentially damaging the baffle and/or adding to the sound of the discharge. Additionally, portions of the wad may be broken off as the wad travels through the suppressor. Pieces of the wad, which is often plastic, may collect with the suppressor. If a shotgun is pointed upwards, pieces of the wad may fall from the suppressor and into the chamber of the shotgun, which may cause the action to jam and/or may cause accidental discharge. Other disadvantages may exist.

SUMMARY

The present disclosure is directed to apparatus, systems, and methods of a shotgun suppressor and a baffle for a shotgun suppressor.

One example of the present disclosure is a shotgun suppressor. The suppressor includes a base having a first end, a second end, and a first passageway through the base from the first end to the second end. The base is configured to be connected to a barrel of a shotgun. The suppressor includes an end cap that includes a bell-shaped protrusion that extends toward the base. The bell-shaped protrusion includes a central opening. The end cap includes a second passageway through the central opening of the bell-shaped protrusion of the end cap. The suppressor includes at least one baffle positioned between the base and the end cap.

The baffle includes a lower portion having a first end, a second end, an exterior, an interior, and a first flow path through the interior of the lower portion. The second end of the lower portion of the baffle has a first outer diameter. The baffle includes an external shoulder on the exterior of the lower portion. The baffle includes external threads on the exterior of the lower portion. The external threads are adjacent to the second end of the lower portion. The baffle includes an upper portion having an interior, an exterior, and a second flow path through the interior of the upper portion. The upper portion of the baffle extends from the second end of the lower portion. The upper portion of the baffle includes a first end, a middle section, and a second end. The first end of the upper portion of the baffle has a second outer diameter that is substantially the same as the first outer diameter of the second end of the lower portion. The middle section of the baffle has a third outer diameter that is smaller than the second outer diameter of the first end of the upper portion. The second end of the upper portion of the baffle has a fourth outer diameter. The fourth outer diameter is larger than the third outer diameter of the middle section and is smaller than the second outer diameter of the first end of the upper portion.

The end cap may include a plurality of prongs on an exterior of the end cap. The plurality of prongs may extend away from the base. The second passageway may extend between the plurality of prongs. The end cap may include rifling on an interior of the bell-shaped protrusion of the end cap. The at least one baffle may include rifling. The rifling may be located on an interior of the bell-shaped protrusion of the at least one baffle.

The baffle includes a first radius of curvature on the exterior of the upper portion. The first radius of curvature is located between the first end of the upper portion and the middle section of the upper portion. The first radius of curvature decreases from the second outer diameter to the third outer diameter. The baffle includes a second radius of curvature on the exterior of the upper portion. The second radius of curvature is located between the middle section of the upper portion of the baffle and the second end of the upper portion of the baffle. The second radius of curvature increases from the third outer diameter to the fourth outer diameter. The first passageway of the base, the first flow path of the lower portion of the baffle, the second flow path of the upper portion of the baffle, and the second passageway of the end cap are all axially aligned.

The third outer diameter of the baffle may be substantially constant between the first radius of curvature and the second radius of curvature. The suppressor may include a first tube extension positioned between the base and the end cap. The first tube extension includes a third passageway through an interior of the first tube extension. The first passageway, the second passageway, the third passageway, the first flow path, and the second flow path are all axially aligned.

The exterior threads may be located between the external shoulder and the upper portion of the at least one baffle. The suppressor may include a plurality of flats on the exterior of the lower portion of the at least one baffle. The plurality of flats are located between the external shoulder and the first end of the lower portion of the baffle. The second end of the upper portion of the baffle may be bell-shaped.

The suppressor may include a second baffle positioned between the base and the end cap. The second baffle may include a lower portion having a first end, a second end, an exterior, an interior, and a first flow path through the interior of the lower portion. The second baffle may include an upper portion having an interior, an exterior, and a second flow path through the interior of the upper portion. The upper portion may extend from the second end of the lower portion. The upper portion may include a first end, a middle section, and a second end. The second end of the upper portion of the second baffle may bell-shaped. The suppressor may include a second tube extension positioned between the at least one baffle and the second baffle.

One embodiment of the present disclosure is an end cap for a shotgun suppressor. The end cap includes a first end and a second end. The end cap includes a central passage the extends through the end cap from the second end to the first end. The end cap includes a bell-shaped protrusion along the central passage.

The end cap may include rifling on an interior of the bell-shaped protrusion. The end cap may include a plurality of prongs that extend away from the first end of the end cap. The central passage may extend between the plurality of prongs. A gap may be formed between each prong of the plurality of prongs. The end cap may include a plurality of ports. Each port of the plurality of ports may be positioned between a prong of the plurality of prongs and an outer edge of the first end. The end cap may include a plurality of cuts in the first end. Each cut of the plurality of cuts may be positioned between two prongs of the plurality of prongs.

One embodiment of the disclosure is a baffle for a shotgun suppressor. The baffle includes a lower portion having a first end, a second end, an exterior, an interior, and a first flow path through the interior of the lower portion. The second end of the lower portion has a first outer diameter. The baffle includes an upper portion having an interior, an exterior, and a second flow path through the interior of the upper portion. The upper portion extends from the second end of the lower portion. The upper portion includes a first end, a middle section, and a second end. The second end of the upper portion is bell-shaped.

The second end of the upper portion may have a larger outer diameter than an outer diameter of the middle section. The baffle may comprise a first radius of curvature on the exterior of the upper portion, the first radius of curvature is located between the first end of the upper portion and the middle section of the upper portion, wherein the first radius of curvature decreases an outer diameter of the upper section. The baffle may comprise a second radius of curvature on the exterior of the upper portion, the second radius of curvature is located between the middle section of the upper portion and the second end of the upper portion, wherein the second radius of curvature increases the outer diameter of the upper section. The middle section of the upper portion may include a portion having a constant diameter located between the first radius of curvature and the second radius of curvature. The baffle may include rifling on an interior of the upper portion.

Figure 1:
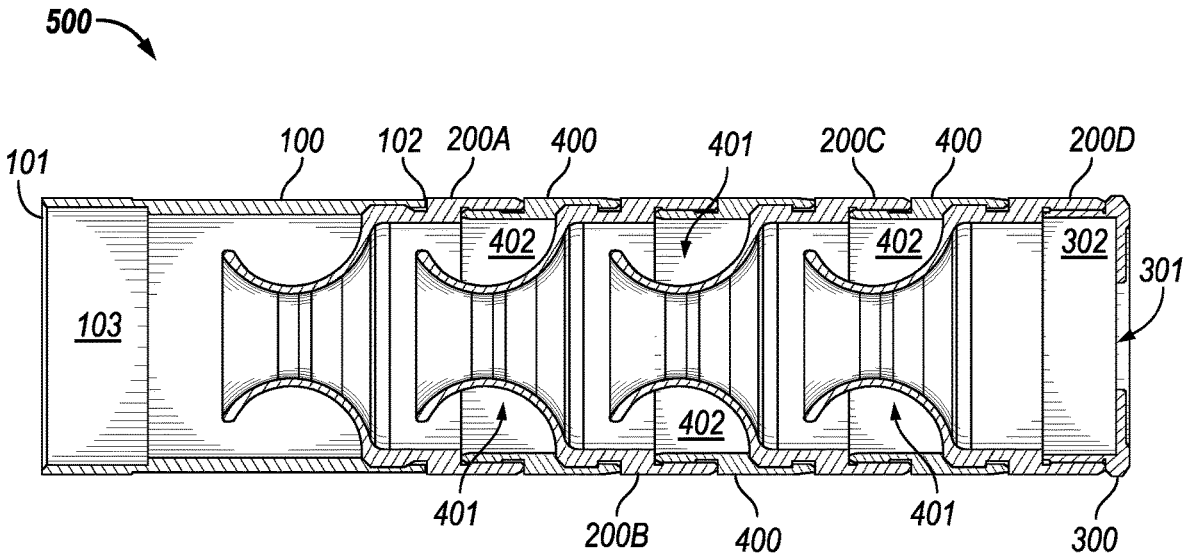
FIG. 1 is a cross-sectional view of an embodiment of a suppressor for a shotgun.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows a cross-sectional view of a suppressor 500 for a shotgun. The suppressor 500 includes a base 100 and an end cap 300. The suppressor 500 includes one or more baffles 200A, 200B, 200C, 200D positioned between the base 100 and the end cap 300. The baffles 200A, 200B, 200C, 200D are configured to suppress the sound of the discharge of a shotgun when the base 100 is attached to the barrel of the shotgun. The bell-shaped baffles 200A, 200B, 200C, 200D discussed herein suppress the discharge while preventing pieces of the wad to break off as the wad travels through the suppressor 500. The wide opening of each baffle 200A, 200B, 200C, 200D enables the wad to enter into the individual baffle while the constriction of the middle section of the baffle compacts the wad together as it passes through each baffle as discussed herein.

The suppressor 500 includes three tube extensions 400 with each of the tube extensions 400 being positioned between adjacent baffles 200A, 200B, 200C, 200D. The tube extensions 400 space apart the baffles 200A, 200B, 200C, 200D. The suppressor includes a base having a first end 101, a second end 102, and a first passageway 103 through the base 100 from the first end 101 to the second end 102. The base 100 configured to be connected to a barrel of a shotgun as would be appreciated by one of ordinary skill having the benefit of this disclosure. The suppressor 500 includes an end cap 300 having a second passageway 301 through an interior 302 of the end cap 300. The suppressor includes at least one baffle (generally) 200 positioned between the base 100 and the end cap 300.

The number and locations of the tube extensions 400 may be varied as would be appreciated by one of ordinary skill in the art having the benefit of this disclosure. For example, two tube extensions 400 could be positioned between adjacent baffles. Likewise, the number and locations of the baffles 200A, 200B, 200C, 200D may be varied as would be appreciated by one of ordinary skill in the art having the benefit of this disclosure. More or less than four baffles 200 (generally) may be used within the suppressor 500.

Figure 2:
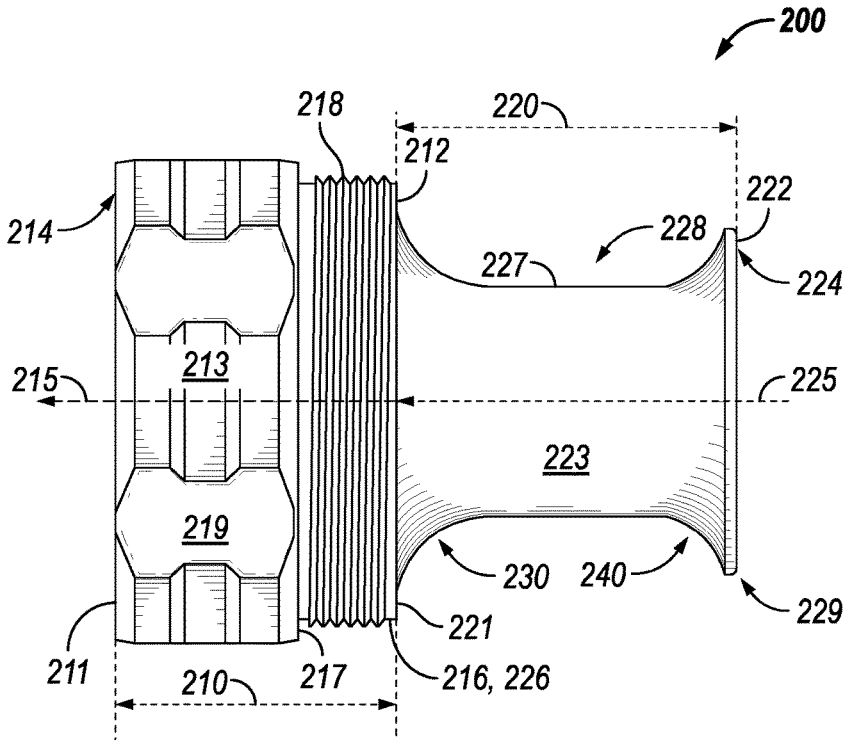
FIG. 2 is a side view of an embodiment of a baffle for a shotgun suppressor.

FIG. 2 shows a side view of a baffle 200. The baffle 200 includes a lower portion 210 having a first end 211, a second end 212, an exterior 213, an interior 214, and a first flow path 215 through the interior 214 of the lower portion 210. The second end of the lower portion 210 of the baffle 200 has a first outer diameter 216. The baffle 200 includes an external shoulder 217 on the exterior 213 of the lower portion 210. The baffle 200 includes external threads 218 on the exterior 213 of the lower portion 210. The external threads 218 are adjacent to the second end 212 of the lower portion 210. The baffle 200 includes an upper portion 220 having a first end 221, a second end 222, an exterior 223, an interior 224, and a second flow path 225 through the interior 224 of the upper portion 220. The upper portion 220 of the baffle 200 extends from the second end 212 of the lower portion 210. The upper portion 220 of the baffle 200 includes a middle section 227 between the first end 221 and the second end 222. The first end 221 of the upper portion 220 of the baffle 200 has a second outer diameter 226 that is substantially the same as the first outer diameter 216 of the second end 212 of the lower portion 210. The middle section 227 of the baffle 200 has a third outer diameter 228 that is smaller than the second outer diameter 226 of the first end 221 of the upper portion 220. The second end 222 of the upper portion 220 of the baffle 200 has a fourth outer diameter 229. The fourth outer diameter 229 is larger than the third outer diameter 228 of the middle section 227 and is smaller than the second outer diameter 226 of the first end 221 of the upper portion 220.

The baffle 200 includes a first radius of curvature 230 on the exterior 223 of the upper portion 220. The first radius of curvature 230 is located between the first end 221 of the upper portion 220 and the middle section 227 of the upper portion 220. The first radius of curvature 230 decreases from the second outer diameter 226 to the third outer diameter 228. The baffle 200 includes a second radius of curvature 240 on the exterior 223 of the upper portion 220. The second radius of curvature 240 is located between the middle section 227 of the upper portion 220 of the baffle 200 and the second end 222 of the upper portion 220 of the baffle 200. The second radius of curvature 240 increases from the third outer diameter 228 to the fourth outer diameter 229. The first passageway 103 of the base 100, the first flow path 215 of the lower portion 210 of the baffle 200, the second flow path 225 of the upper portion 220 of the baffle 200, and the second passageway 301 of the end cap 300 are all axially aligned.

The third outer diameter 228 of the upper portion 220 of the baffle 200 may be substantially constant between the first radius of curvature 203 and the second radius of curvature 240. As shown in FIG. 1, a suppressor 500 that includes the baffle 200 may also include a first tube extension 400 positioned between the base 100 and the end cap 300. The first tube extension 400 includes a third passageway 401 through an interior 402 of the first tube extension 400. The first passageway 103, the second passageway 301, the third passageway 401, the first flow path 215, and the second flow path 225 are all axially aligned.

The exterior threads 218 of the baffle 200 are located between the external shoulder 217 and the upper portion 220 of the baffle 200. The baffle 200 includes a plurality of flats 219 on the exterior 213 of the lower portion 210. The flats 219 may enable the baffle 200 to be connected to and disconnect from components of a suppressor 500. The plurality of flats 219 are located between the external shoulder 217 and the first end 211 of the lower portion 210 of the baffle 200. The second end 222 of the upper portion 220 of the baffle 200 may be bell-shaped as shown in FIG. 2. The wide bell-shaped opening of the second end 222 of the upper portion 220 of the baffle 200 is configured to enable the entire wad to enter into the baffle 200. The decreasing second radius of curvature 240 in combination with the smaller third outer diameter 228 of the middle section 227 of the upper portion 220 of the baffle 200 compress the wad together as it travels through the baffle 200. This compression may help to ensure that the entire wad enters into the next baffle 200 located in the suppressor 500.

Figure 3:
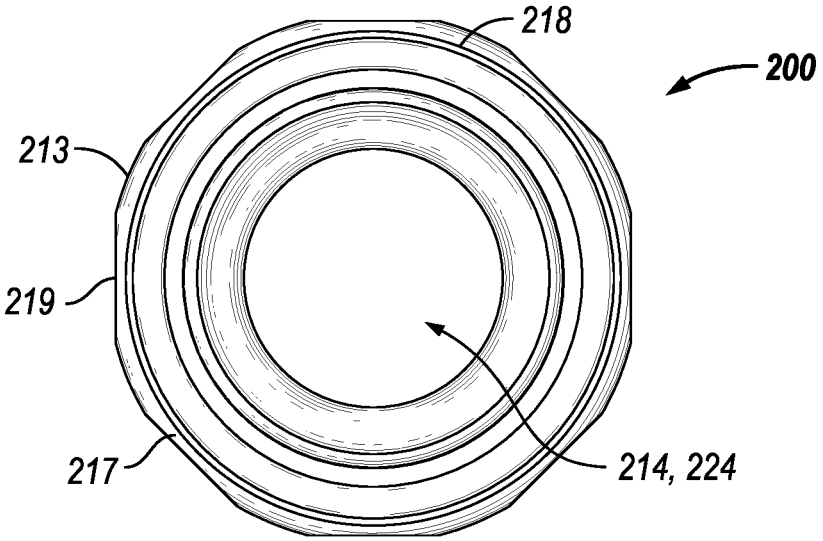
FIG. 3 is an end view of an embodiment of a baffle for a shotgun suppressor.
Figure 4:
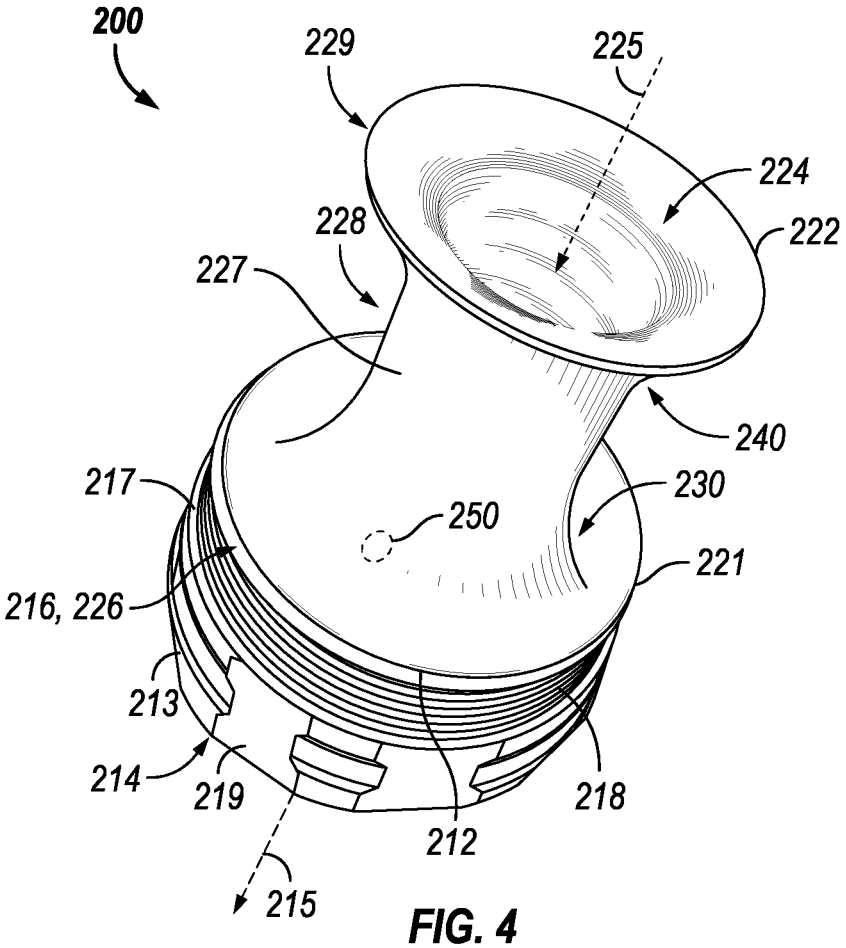
FIG. 4 is a perspective view of an embodiment of a baffle for a shotgun suppressor.
Figure 5:
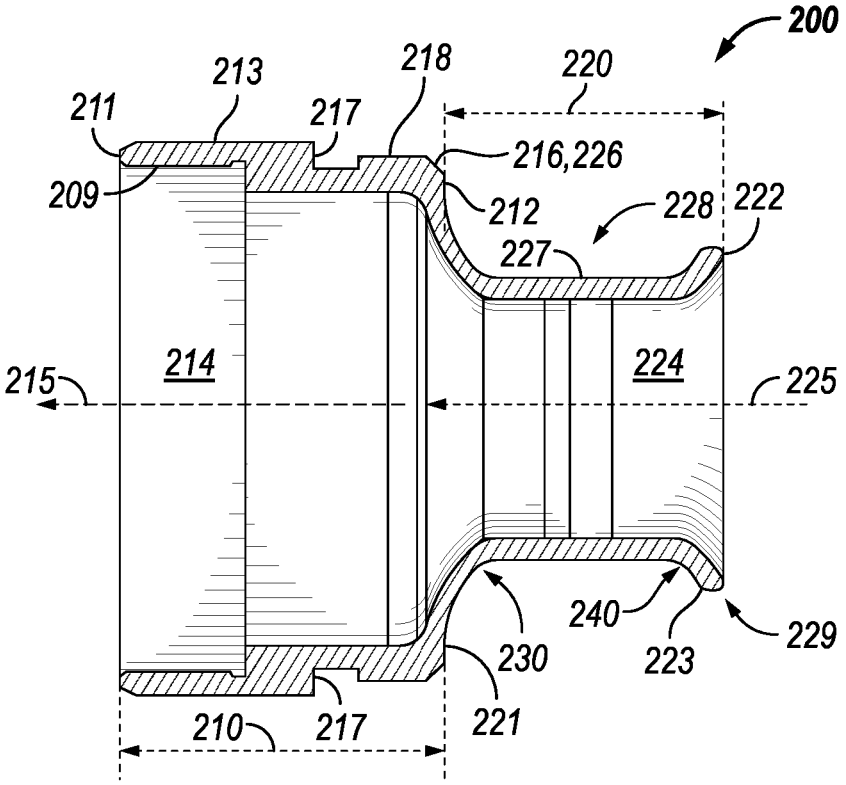
FIG. 5 is a cross-sectional view of an embodiment of a baffle for a shotgun suppressor.
Figure 6A:
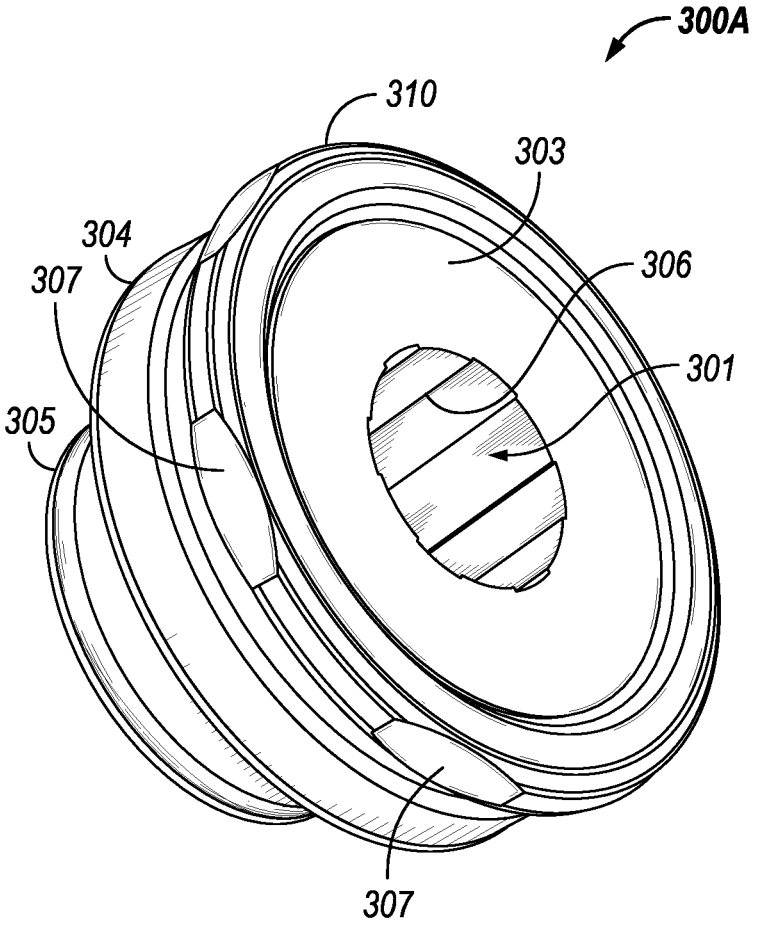
FIGS. 6A-6D show an embodiment of an end cap for a suppressor for a shotgun.
Figure 6B:
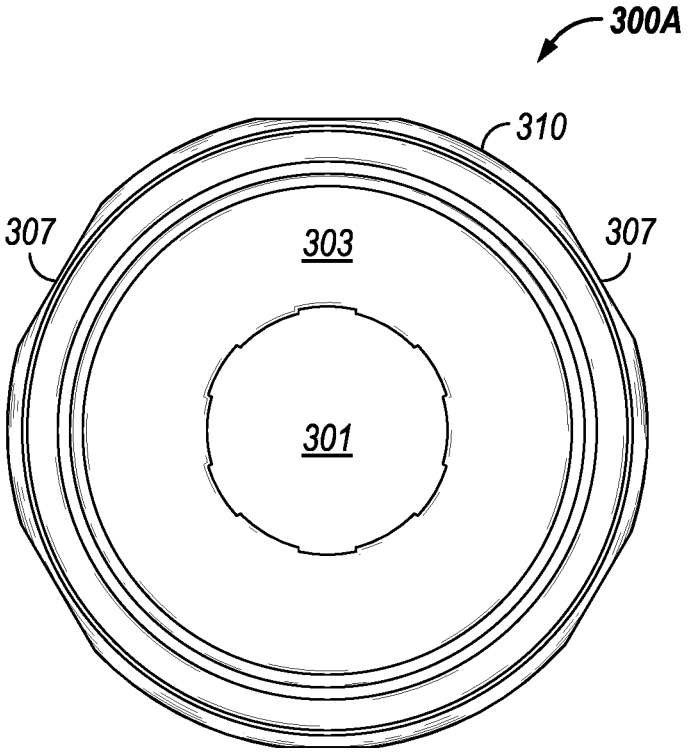
Figure 6C:
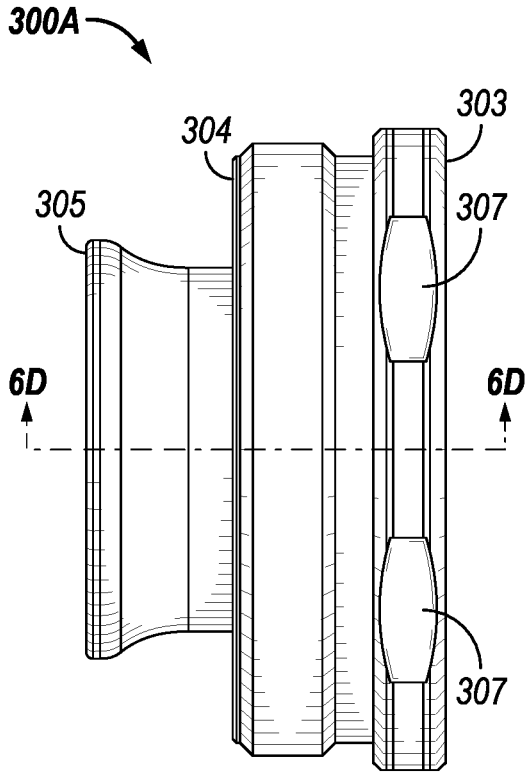
Figure 6D:
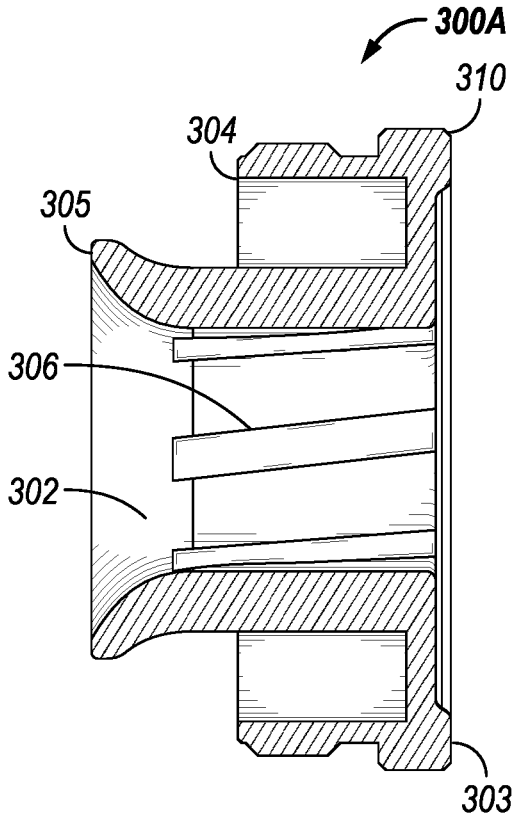
Figure 7A:
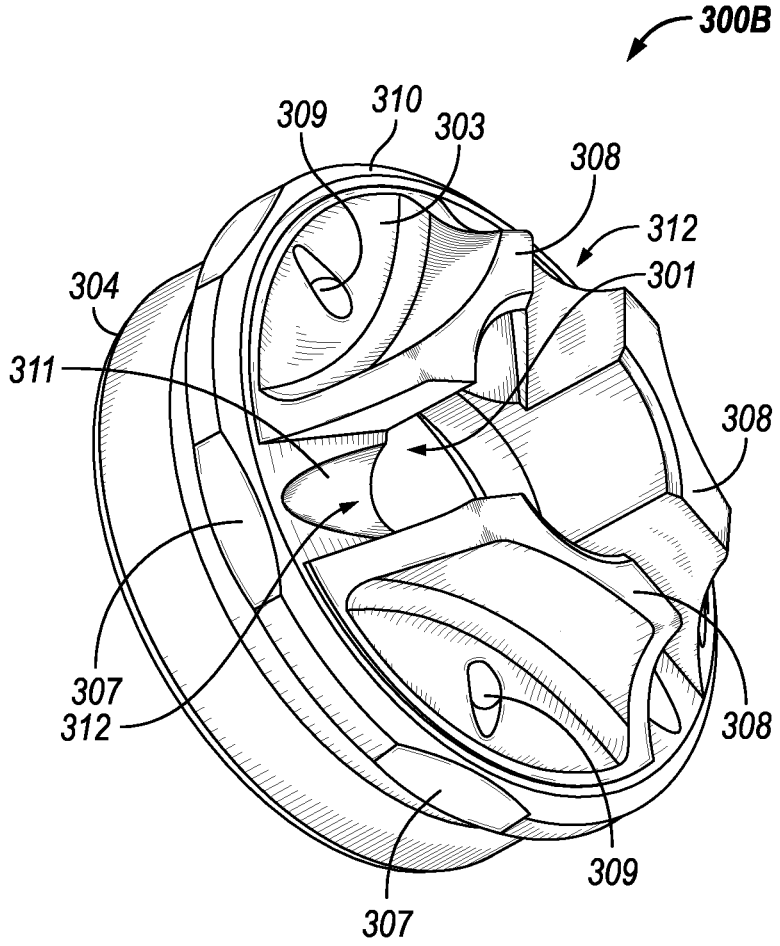
FIGS. 7A-7D show an embodiment of an end cap for a suppressor for a shotgun.
Figure 7B:
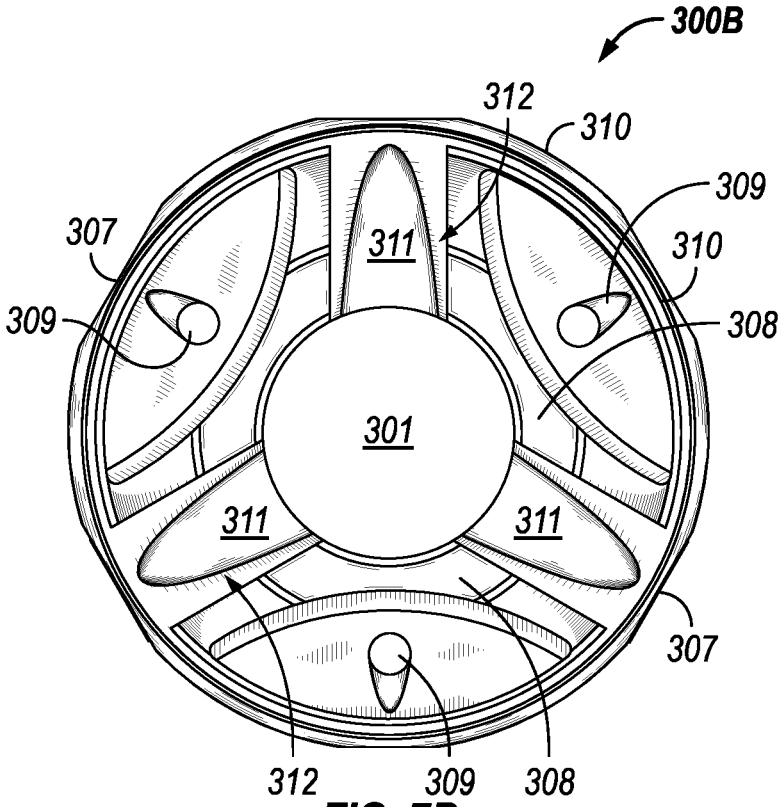
Figure 7C:
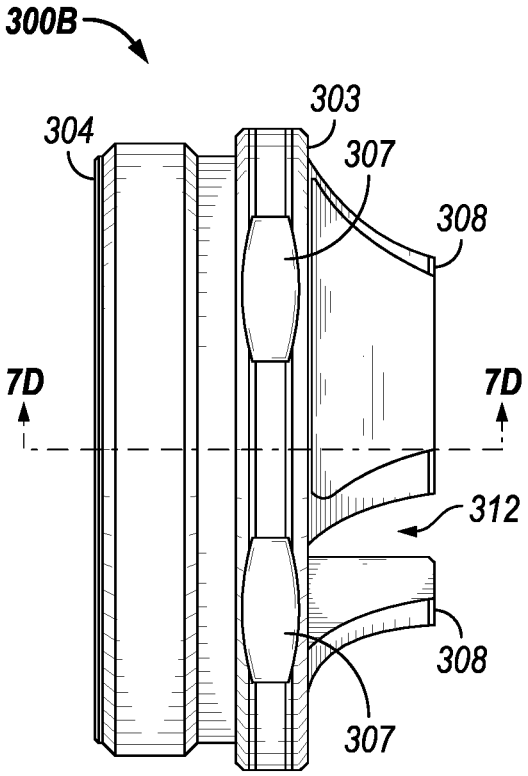
Figure 7D:
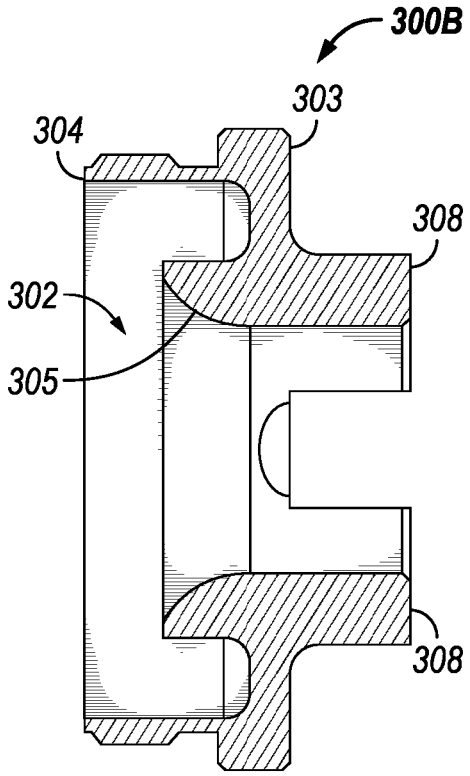

FIG. 3 is an end view of a baffle 200 for a shotgun suppressor 500 and shows the interiors 214, 224 of the lower portion 210 (best shown in FIG. 2) and upper portion 220 (best shown in FIG. 2) of the baffle 200. FIG. 4 is a perspective view of a baffle 200 for a shotgun suppressor 500. FIG. 5 is a cross-sectional view of a baffle 200 for a shotgun suppressor 500. The baffle 200 includes a plurality of flats 219 located around the exterior 213 that enable a tool to be used to remove or attach the baffle 200 to components of a suppressor 500. The external threads 218 and the internal threads 209 (shown in FIG. 5) enable the baffle 200 to be threaded to the base 100, an extension tube 400, and/or an end cap 300 as would be appreciated by one of ordinary skill in the art having the benefit of this disclosure.

The baffle 200 may include one or more holes 250 in the upper portion 220 of the baffle 200. The one or more holes 250 enable fluid communication between the exterior 223 of the upper portion 220 of the baffle 200 and the interior 224 of the upper portion 220 of the baffle 200. The addition of one or more holes 250 may enable the baffle 200 to better reduce the discharge of a shotgun when connected to the shotgun as a component within a suppressor 500.

As shown in FIGS. 1-5, an embodiment of the disclosure is a baffle 200 for a shotgun suppressor 500. The baffle 200 includes a lower portion 210 having a first end 211, a second end 212, an exterior 213, an interior 214, and a first flow path 215 through the interior 214 of the lower portion 210. The second end 212 of the lower portion 210 has a first outer diameter 216. The baffle 200 includes an upper portion 220 having an interior 224, an exterior 223, and a second flow path 225 through the interior 224 of the upper portion 220. The upper portion 220 extends from the second end 212 of the lower portion 210. The upper portion 220 includes a first end 221, a middle section 227, and a second end 222. The second end 222 of the upper portion 220 is flared out and has a larger outer diameter 229 than an outer diameter 228 of the middle section 227. The baffle 200 includes external threads 218 on the exterior 213 of the lower portion 210. The baffle 200 includes internal threads 209 on the interior 214 of the lower portion 210.

FIGS. 6A-6D show an embodiment of an end cap 300A for a suppressor 500 (shown in FIG. 1) for a shotgun. The end cap 300A includes a first end 303 and a second end 304. The end cap 300A includes a bell-shaped protrusion 305 that extends from the first end 303 beyond the second end 304 of the end cap 300A. The bell-shaped protrusion 305 is configured to prevent pieces of the wad from breaking off as the wad travels through the suppressor 500 as discussed herein. The end cap 300A includes a second passageway 301 through the end cap 300A. An interior 302 of the end cap 300A includes rifling 306. The rifling may be 1:35 inch rifling. The end cap 300A may be used on a suppressor 500 for the discharge of slugs, sabot rounds, and/or rifled slugs. If the user desires to shoot buckshot or birdshot, a smooth bore end cap may be swapped out for the end cap 300A due to the modular nature of the end cap 300A and the suppressor 500. The end cap 300A includes a plurality of flats 307 on the exterior that may enable the removal from or installation onto the suppressor 500. The end cap 300A includes an outer upper edge 310.

FIGS. 7A-7D show an embodiment of an end cap 300B for a suppressor 500 (shown in FIG. 1) for a shotgun. The end cap 300B includes a first end 303 and a second end 304. The end cap 300B includes a bell-shaped protrusion 305 that is positioned within an interior 302 of the end cap 300B. The bell-shaped protrusion 305 extends from the first end 303 of the end cap 300B toward the second end 304 of the end cap 300B. The bell-shaped protrusion 305 is configured to prevent pieces of the wad from breaking off as the wad travels through the suppressor 500 as discussed herein. The end cap 300B includes a second passageway 301 through the end cap 300B. The end cap 300A includes a plurality of flats 307 on the exterior that may enable the removal from or installation onto the suppressor 500. The end cap 300A includes an outer upper edge 310.

The end cap 300B includes a plurality of prongs 308 on the first end 303 of the end cap 300B. The plurality of prongs 308 may be effective in breaching operations permitting the user to maintain a controlled distance and/or angle when breaching entry point locking mechanisms. The end cap 300B includes a plurality of ports 309 through the first end 303 of the end cap 300B. The ports 309 may reduce back pressure and/or reduce muzzle flash during the discharge of a shotgun. Each of the ports 309 are positioned between a prong 308 and the outer edge 310 of the first end 303 of the end cap 300B. The end cap 300B includes a gap 312 between each of the prongs 308 on the first end 303 of the end cap 300B. The end cap 300B includes a cut, or flute, 311 in the first end 303 of the end cap 300B between adjacent prongs 308. The cuts 311 and gaps 312 help to minimize and disperse muzzle flash as well as prevent potential ignition of any unused propellant.

Figure 8A:
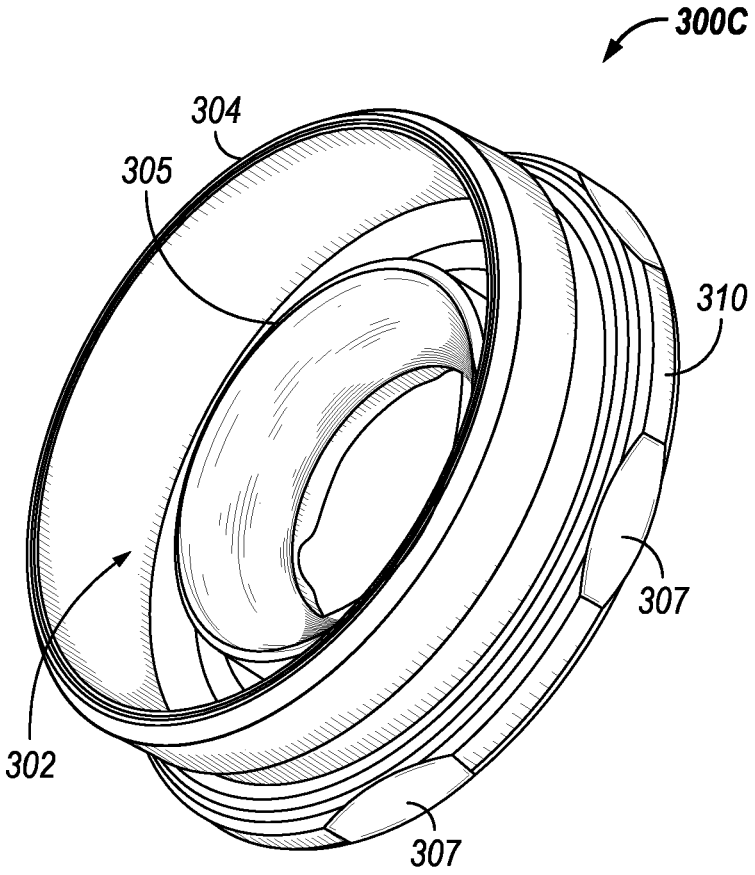
FIGS. 8A-8C show an embodiment of an end cap for a suppressor for a shotgun.
Figure 8B:
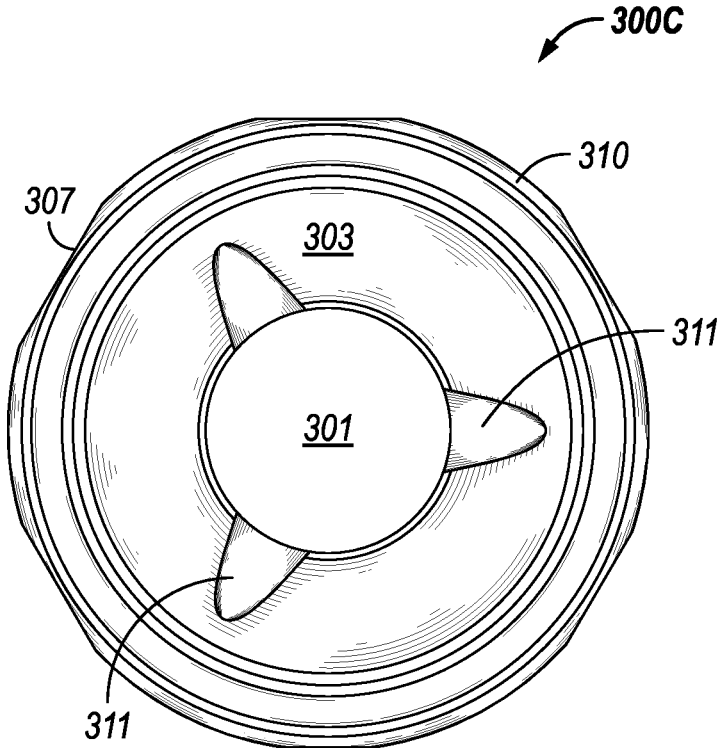
Figure 8C:
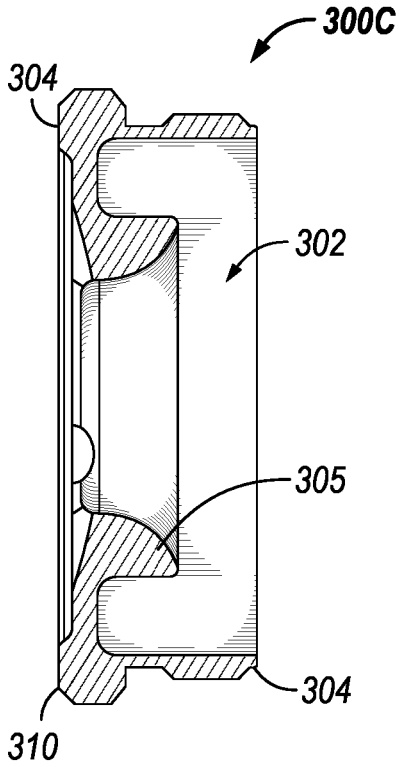

FIGS. 8A-8C show an embodiment of an end cap 300C for a suppressor 500 (shown in FIG. 1) for a shotgun. The end cap 300C includes a first end 303 and a second end 304. The end cap 300C includes a bell-shaped protrusion 305 that extends from the first end 303 toward the second end 304 of the end cap 300C. The bell-shaped protrusion 305 is positioned within the interior 302 of the end cap 300C. The bell-shaped protrusion 305 is configured to prevent pieces of the wad from breaking off as the wad travels through the suppressor 500 as discussed herein. The end cap 300C includes a second passageway 301 through the end cap 300C. The bell-shaped protrusion 305 is positioned within an interior 302 of the end cap 300C. The end cap 300C includes a plurality of flats 307 on the exterior that may enable the removal from or installation onto the suppressor 500. The end cap 300C includes an outer upper edge 310. The top end 303 of the end cap 300C includes a plurality of cuts, or flutes, 311 that may help to minimize and disperse muzzle flash as well as prevent potential ignition of any unused propellant.

Figure 9A:
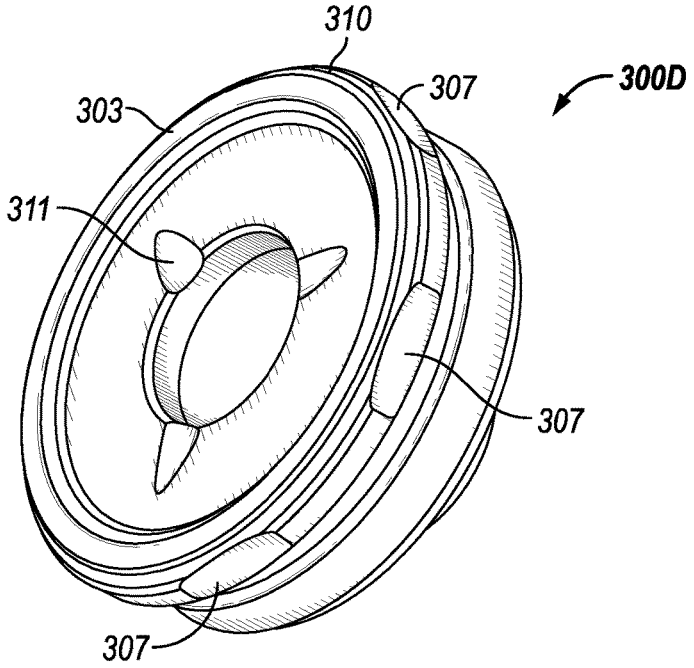
FIGS. 9A-9C show an embodiment of an end cap for a suppressor for a shotgun.
Figure 9B:
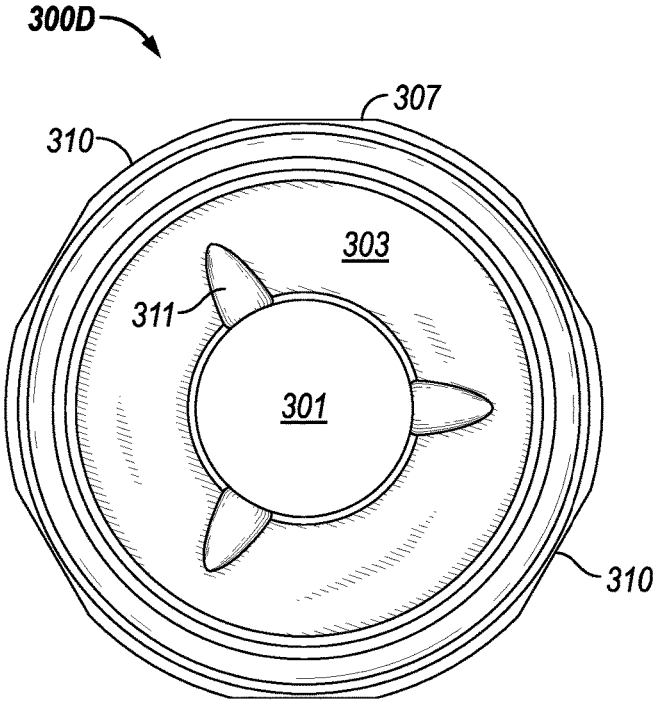
Figure 9C:
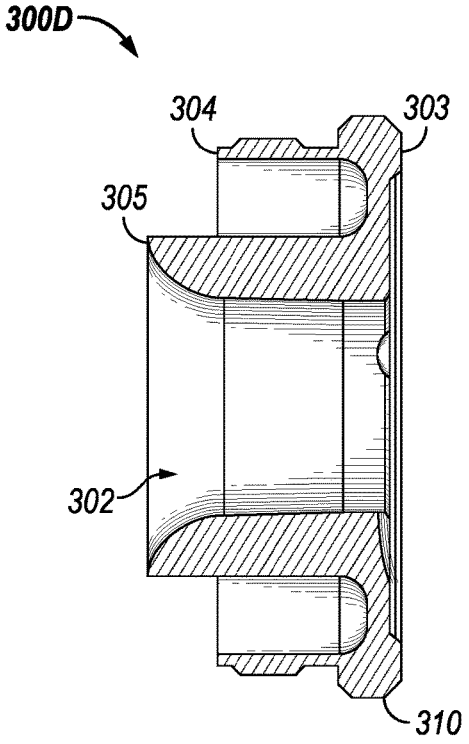

FIGS. 9A-9C show an embodiment of an end cap 300D for a suppressor 500 (shown in FIG. 1) for a shotgun. The end cap 300D includes a first end 303 and a second end 304. The end cap 300D includes a bell-shaped protrusion 305 that extends from the first end 303 beyond the second end 304 of the end cap 300D. The bell-shaped protrusion 305 is configured to prevent pieces of the wad from breaking off as the wad travels through the suppressor 500 as discussed herein. The end cap 300D includes a second passageway 301 through the end cap 300D. The end cap 300D includes a plurality of flats 307 on the exterior that may enable the removal from or installation onto the suppressor 500. The end cap 300D includes an outer upper edge 310. The top end 303 of the end cap 300D includes a plurality of cuts, or flutes, 311 that may help to minimize and disperse muzzle flash as well as prevent potential ignition of any unused propellant. The bell-shaped protrusion 305 of the end cap 300D of FIGS. 9A-9C has a longer length than the bell-shaped protrusion of the end cap 300C shown in FIGS. 8A-8C. The bell-shaped protrusion is configured to be a shotgun choke and may be used with bird shot and buck shot.

Figure 10B:
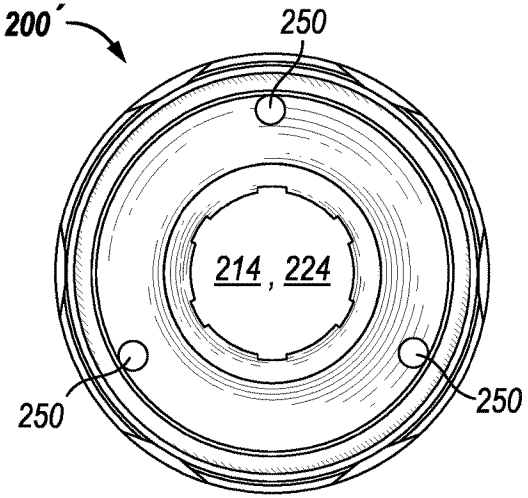
FIGS. 10A-10C show an embodiment of a baffle for a suppressor for a shotgun.
Figure 10A:
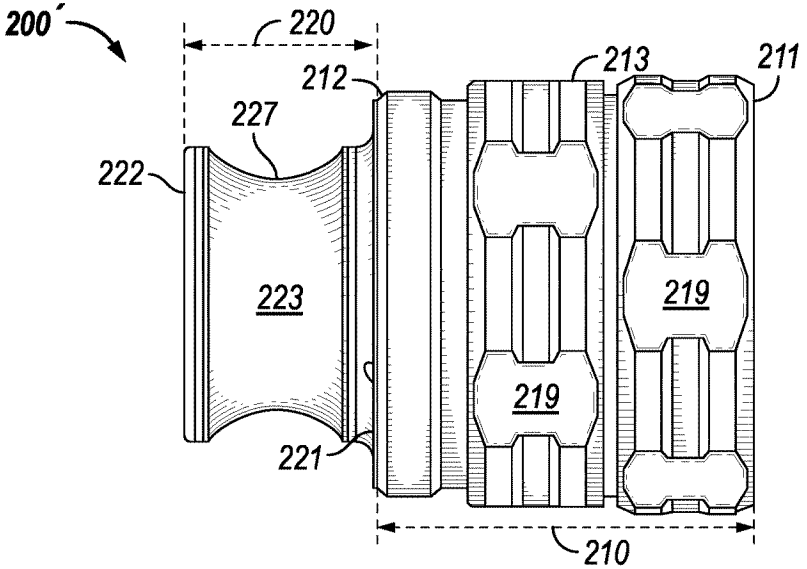
Figure 10C:
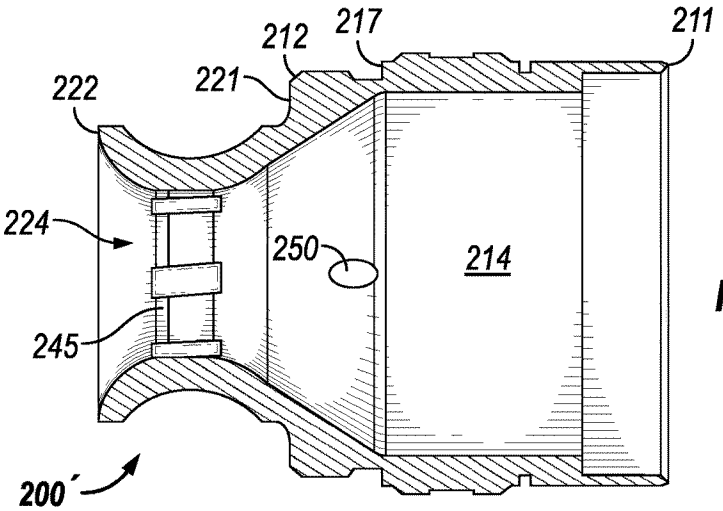

FIGS. 10A-10C show an embodiment of a baffle 200' that may as part of a shotgun suppressor 500 (shown in FIG. 1). The baffle 200' may replace the baffle 200 shown in FIGS. 2-4 as would be appreciated by one of ordinary skill in the art having the benefit of this disclosure. The baffle 200' includes a lower portion 210 having a first end 211, a second end 212, an exterior 213, an interior 214, and a first flow path through the interior 214 of the lower portion 210. The baffle 200' includes an external shoulder 217 on the exterior 213 of the lower portion 210. The baffle 200' includes external threads on the exterior 213 of the lower portion 210. The external threads are adjacent to the second end 212 of the lower portion 210. The baffle 200' includes an upper portion 220 having a first end 221, a second end 222, an exterior 223, an interior 224, and a second flow path through the interior 224 of the upper portion 220. The upper portion 220 of the baffle 200' extends from the second end 212 of the lower portion 210. The upper portion 220 of the baffle 200' includes a middle section 227 between the first end 221 and the second end 222.

The baffle 200' includes a first radius of curvature on the exterior 223 of the upper portion 220 between the first end 221 of the upper portion 220 and the middle section 227 of the upper portion 220. The first radius of curvature decreases from a larger outer diameter to a smaller outer diameter. The baffle 200' includes a second radius of curvature on the exterior 223 of the upper portion 220 located between the middle section 227 of the upper portion 220 of the baffle 200' and the second end 222 of the upper portion 220 of the baffle 200'. The second radius of curvature increases from a smaller outer diameter to a larger outer diameter.

The baffle 200' includes a plurality of flats 219 on the exterior 213 of the lower portion 210. The flats 219 may enable the baffle 200' to be connected to and disconnect from components of a suppressor 500. The plurality of flats 219 are located between the external shoulder 217 and the first end 211 of the lower portion 210 of the baffle 200'. The second end 222 of the upper portion 220 of the baffle 200' is bell-shaped as shown in FIGS. 10A and 10C. The wide bell-shaped opening of the second end 222 of the upper portion 220 of the baffle 200' is configured to enable the entire wad to enter into the baffle 200'. The decreasing second radius of curvature of the baffle 200' compress the wad together as it travels through the baffle 200'. This compression may help to ensure that the entire wad enters into the next baffle 200' located in the suppressor 500.

The interior 224 of the upper portion 220 of the baffle 200' includes rifling 245. The rifling may be 1:35 inch rifling. The baffle 200' may be used on a suppressor 500 for the discharge of slugs, sabot rounds, and/or rifled slugs. If the user desires to shoot buckshot or birdshot, a smooth bore baffle 200 may swapped out for the baffle 200' with rifling 245 due to the modular nature of the baffles 200, 200' and the suppressor 500.

The baffle 200' may include one or more holes 250 in the upper portion 220 of the baffle 200'. The one or more holes 250 enable fluid communication between the exterior 223 of the upper portion 220 of the baffle 200' and the interior 224 of the upper portion 220' of the baffle 200'. The addition of one or more holes 250 may enable the baffle 200' to better reduce the discharge of a shotgun when connected to the shotgun as a component within a suppressor 500.

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A shotgun suppressor comprising:

a base having a first end, a second end, and a first passageway through the base from the first end to the second end, the base configured to be connected to a barrel of a shotgun;

an end cap, the end cap having a bell-shaped protrusion that extends toward the base, the bell-shaped protrusion having a central opening and rifling on an interior of the bell-shaped protrusion, the end cap having a second passageway through the central opening of the bell-shaped protrusion of the end cap;

at least one baffle positioned between the base and the end cap, the at least one baffle comprising:

a lower portion having a first end, a second end, an exterior, an interior, and a first flow path through the interior of the lower portion, wherein the second end of the lower portion has a first outer diameter;

an external shoulder on the exterior of the lower portion;

external threads on the exterior of the lower portion, wherein the external threads are adjacent to the second end of the lower portion;

an upper portion having an interior, an exterior, and a second flow path through the interior of the upper portion, the upper portion extends from the second end of the lower portion, the upper portion having a first end, a middle section, and a second end;

the first end of the upper portion has a second outer diameter that is substantially the same as the first outer diameter of the second end of the lower portion;

the middle section has a third outer diameter that is smaller than the second outer diameter of the first end of the upper portion;

the second end of the upper portion has a fourth outer diameter, wherein the fourth outer diameter is larger than the third outer diameter of the middle section and is smaller than the second outer diameter of the first end of the upper portion;

a first radius of curvature on the exterior of the upper portion, the first radius of curvature is located between the first end of the upper portion and the middle section of the upper portion, wherein the first radius of curvature decreases from the second outer diameter to the third outer diameter; and a second radius of curvature on the exterior of the upper portion, the second radius of curvature is located between the middle section of the upper portion and the second end of the upper portion, wherein the second radius of curvature increases from the third outer diameter to the fourth outer diameter; and wherein the first passageway, the first flow path, the second flow path, and the second passageway are all axially aligned.

2. The shotgun suppressor of claim 1, wherein the end cap includes a plurality of prongs on an exterior of the end cap, wherein the plurality of prongs extend away from the base.

3. The shotgun suppressor of claim 2, wherein the second passageway extends between the plurality of prongs.

4. The shotgun suppressor of claim 1, wherein the at least one baffle includes rifling.

5. The shotgun suppressor of claim 1, wherein the rifling is located along an interior of the bell-shaped protrusion of the at least one baffle.

6. The shotgun suppressor of claim 1, wherein the third outer diameter is substantially constant between the first radius of curvature and the second radius of curvature.

7. The shotgun suppressor of claim 6, further comprising a first tube extension positioned between the base and the end cap, the first tube extension including a third passageway through an interior of the first tube extension and wherein the first passageway, the second passageway, the third passageway, the first flow path, and the second flow path are all axially aligned.

8. The shotgun suppressor of claim 7, wherein the exterior threads are located between the external shoulder and the upper portion of the at least one baffle.

9. The shotgun suppressor of claim 8, further comprising a plurality of flats on the exterior of the lower portion of the at least one baffle, wherein the plurality of flats are located between the external shoulder and the first end of the lower portion of the at least one baffle.

10. The shotgun suppressor of claim 9, wherein second end of the upper portion of the at least one baffle is bell-shaped.

11. The shotgun suppressor of claim 10, further comprising a second baffle positioned between the base and the end cap, the second baffle comprises:

a lower portion having a first end, a second end, an exterior, an interior, and a first flow path through the interior of the lower portion;

an upper portion having an interior, an exterior, and a second flow path through the interior of the upper portion, the upper portion extends from the second end of the lower portion, the upper portion having a first end, a middle section, and a second end; and wherein the second end of the upper portion of the second baffle is bell-shaped.

12. The shotgun suppressor of claim 11, further comprising a second tube extension positioned between the at least one baffle and the second baffle.

13. An end cap for a shotgun suppressor, the end cap comprising:

a first end;

a second end;

a central passage that extends through the end cap from the second end to the first end;

a bell-shaped protrusion along the central passage and rifling on an interior of the bell-shaped protrusion.

14. The end cap of claim 13 further comprising a plurality of prongs that extend away from the first end of the end cap, wherein the central passage extends between the plurality of prongs and wherein a gap is formed between each prong of the plurality of prongs.

15. The end cap of claim 14, further comprising a plurality of ports, wherein each port of the plurality of ports is positioned between a prong of the plurality of prongs and an outer edge of the first end.

16. The end cap of claim 15, further comprising a plurality of cuts in the first end, wherein each cut of the plurality of cuts is positioned between two prongs of the plurality of prongs.

17. A baffle for a shotgun suppressor, the baffle comprising:

a lower portion having a first end, a second end, an exterior, an interior, and a first flow path through the interior of the lower portion, wherein the second end has a first outer diameter;

an upper portion having an interior comprising rifling on the interior of the upper portion, an exterior, and a second flow path through the interior of the upper portion, the upper portion extends from the second end of the lower portion, the upper portion having a first end, a middle section, and a second end; and wherein the second end of the upper portion is bell-shaped.

18. The baffle of claim 17, wherein the second end of the upper portion has a larger outer diameter than an outer diameter of the middle section.

19. The baffle of claim 18, further comprising:

a first radius of curvature on the exterior of the upper portion, the first radius of curvature is located between the first end of the upper portion and the middle section of the upper portion, wherein the first radius of curvature decreases an outer diameter of the upper section; and a second radius of curvature on the exterior of the upper portion, the second radius of curvature is located between the middle section of the upper portion and the second end of the upper portion, wherein the second radius of curvature increases the outer diameter of the upper section.

20. The baffle of claim 19, wherein the middle section of the upper portion further comprises a portion having a constant diameter located between the first radius of curvature and the second radius of curvature.

* * * * *